US005450702A

United States Patent [19]

Barnett

[11] Patent Number: 5,450,702

[45] Date of Patent: Sep. 19, 1995

[54] DECORATIVE MOLDING

[76] Inventor: Stephen Barnett, 365 Merriomon Ave., Asheville, N.C. 28801

[21] Appl. No.: 116,864

[22] Filed: Sep. 3, 1993

[51] Int. Cl.[6] ..... A47G 1/06

[52] U.S. Cl. ..... 52/656.2; 52/573.1; 52/656.1; 52/DIG. 5; 40/152; 40/154; 428/14

[58] Field of Search ..... 40/152, 154; 52/573.1, 52/656.1, 656.2, 656.9, 727, DIG. 5; 428/14, 913.3

[56] References Cited

U.S. PATENT DOCUMENTS

| | | | |
|---|---|---|---|
| 318,126 | 5/1885 | Marsh | 52/656.9 X |
| 2,189,521 | 2/1940 | King | 40/152 |
| 3,991,537 | 11/1976 | Brown . | |
| 4,235,949 | 11/1980 | Van Manen et al. . | |
| 4,391,054 | 7/1983 | Schovee | 52/656.1 X |
| 4,462,176 | 7/1984 | Schovee | 52/656.1 X |
| 4,489,512 | 12/1984 | Schovee | 52/656.1 X |
| 4,937,958 | 7/1990 | Stein et al. | 40/152 X |
| 5,193,322 | 3/1993 | Wood . | |

FOREIGN PATENT DOCUMENTS

| | | | |
|---|---|---|---|
| 503141 | 5/1951 | Belgium | 40/152 |
| 1393511 | 2/1965 | France | 40/152 |
| 2632509 | 12/1989 | France | 40/152 |
| 383156 | 10/1923 | Germany | 40/152 |
| 717010 | 10/1966 | Italy | 52/656.9 |
| 410043 | 5/1934 | United Kingdom | 52/656.1 |
| 2127741 | 4/1984 | United Kingdom | 40/152 |

*Primary Examiner*—Carl Friedman
*Assistant Examiner*—Kevin D. Wilkens
*Attorney, Agent, or Firm*—Hardaway Law Firm

[57] ABSTRACT

A decorative molding utilizes a tongue and groove system which produces a stable bond between a frame and covering. The frame possesses a projection which corresponds to a groove on the shell, and the two units are slidably engaged to form a connection. This tongue and groove design prevents the shell and frame from being pulled apart except in the direction of the groove. A slot is also provided in the frame to reduce friction between the frame and shell and to alleviate the problem of lateral thermal expansion. A gap is provided in the frame to allow the molding to compensate for linear thermal expansion. This invention not only maximizes stability, flexibility and attractiveness, but also prevents the bowing effect of both linear and lateral thermal expansion on the molding.

12 Claims, 1 Drawing Sheet

DECORATIVE MOLDING

BACKGROUND OF THE INVENTION

The present invention relates to a system for combining the aesthetic value of decorative molding with the sturdiness of a frame.

In the past, wooden frames although sturdy possessed little aesthetic value unless stained or painted. Metal frames also possessed the same limitations as wooden frames. As technology progressed and the use of plastics increased, decorative plastics became a popular alternative to wood and metal. Although these plastics were advantageous in many ways, generally they did not possess the strength and sturdiness of the wooden and metal frames. In order to combine the beneficial properties of the sturdy frames and decorative plastics, these materials were combined to form a unit.

At first, combinations between wood and metal frames and plastic coverings were accomplished by gluing the plastic covering on top of the metal or wooden frame. This procedure evolutionized to a tongue and groove system thus allowing more liberal use of the frame and the covering while still allowing stability of the system. One type of system incorporating this idea is taught in U.S. Pat. No. 3,991,537 to Brown. Brown teaches a chair rail possessing a fixed base and a removable base. The removable base is slidably engaged with a molding in a tongue and groove system and once engaged, the removable base is snapped onto the fixed base.

SUMMARY OF THE INVENTION

It is the object of this invention to provide a decorative molding which overcomes the limitations of the prior art and which allows for the combination of a sturdy frame with the aesthetic value of a decorative plastic covering.

It is a further object of this invention to allow for system flexibility.

It is a still further object to eliminate the effects of both lateral and linear thermal expansion.

In accordance with this invention, these and other objects are accomplished by utilizing a tongue and groove system between the frame and shell and by providing gaps within the frame member. In using a dovetailing system, the consolidation of the frame and shell components can be accomplished by bringing the first edge of the tongued unit in contact with the first edge of the grooved unit and sliding the units together. Generally, the frame unit will be the tongued piece used for this system and the covering used as the groove; however, it is foreseeable that the covering could be the tongued piece and the frame the groove.

In contemplation of this invention, the preferred materials for the frame and shell system are wood and plastic, respectively. However, although these materials are preferable, other materials can also be utilized. Metal, ceramic, or even plastic frames can be used to supply the system with the necessary strength. Similarly, metal and ceramic shells could be used to provide the necessary aesthetic element in the system. The projection whether upon the frame or the inner surface of the shell need not actually be of the same material as the unit onto which said projection is fixed.

An inverted trapezoid template upon the frame base is an advantageous shape for a projection in this type of system. The inverted trapezoid shape is beneficial because it prevents the frame and shell from being pulled apart in a plane perpendicular to that of the groove. This shape also limits the amount of friction between the engaging surfaces of the frame and the shell. Although the inverted trapezoid shape is the preferred shape for the projection used in the tongue and groove system, other shapes are also foreseeable. For instance, a rectangular projection is foreseeable; however, even though this projection would reduce the frictional surface between the two engaging surfaces, it also allows for the shell and frame to be separated at an axis perpendicular to the groove. A tongue and groove system utilizing an H-type construction would alleviate the problem of the components being pulled apart but would also increase the frictional surface upon the engaging surfaces. An H-type construction would be accomplished by incorporating into the tongued surface opposing rectangular projections that extend from the base of the tongued unit. The projections used in the H-type construction and the original inverted trapezoid constructions can take on any other foreseeable shape especially with recent advances in manufacturing technology. For example, such shapes could include circular or pointed type projections or any combination of different shapes. Also, the template could include two or more projections upon which the frame and shell engage.

It is preferable in utilizing this tongue and groove construction to also provide for a slot along an engaging edge. A slot can be formed by removing material from the edge of either the frame or shell unit. Incorporating a slot into the system decreases the sliding frictional surface and at the same time alleviates the problem of lateral thermal expansion by allowing more room for expansion.

Once the members are engaged, it is also beneficial to provide gaps in the frame within the shell to allow the system to compensate for differing rates of thermal expansion, especially in the linear direction. Without the existence of a gap, the system cannot expand freely in the linear direction thus causing the system to bow and irreversible damage to result. A frame gap large enough to handle wide temperatures ranges while still maintaining the strength of the unit is optimal for this construction.

The described invention could be employed for a variety of uses, i.e. picture frames, door and other types of frames, moldings, furniture, handrails, panels, tiles. There are also many equivalent uses that might exist for such a system.

DETAILED DESCRIPTION

In accordance with this invention, it has been discovered that a tongue and groove system is effective in combining the aesthetic value of decorative plastic and the strength of a wooden frame and diminishing the effects of lateral thermal expansion. It has also been found that a gap located in the frame alleviates the problem of linear thermal expansion. In accomplishing this objective, the invention overcomes difficulties resulting from differing rates of thermal expansion between the frame and shell and also provides flexibility in the choice of coverings.

Figure 1:
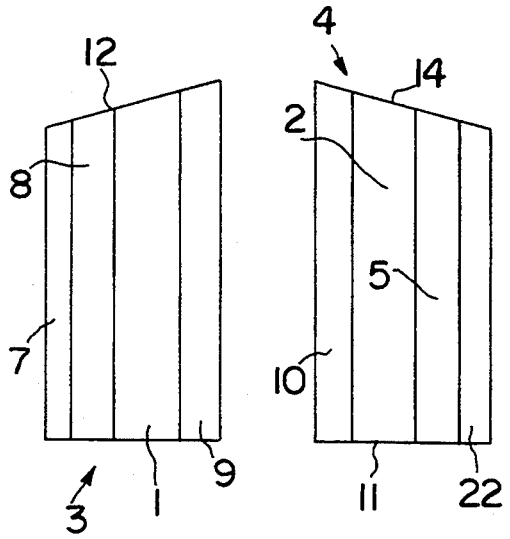
FIG. 1 is an exploded view of a shell and frame comprising a decorative molding constructed in accordance with a preferred embodiment of the present invention.
Figure 5:
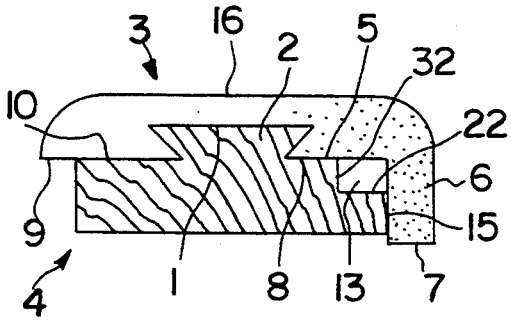
FIG. 5 is a sectional elevation view of a decorative molding constructed in accordance with the preferred embodiment of the present invention containing a slot along an engaging edge between the frame and shell.

FIG. 1 illustrates two separate units, namely a shell 3 and a frame 4. The shell 3 is preferably a unitary piece with inner engaging surfaces including a groove 1 formed therein, recessed between first and second coplanar surfaces 8 and 9, respectively. The shell 3 is provided with an outer decorative surface 16, and a portion of shell 3 projects outwardly from surface 8 to form a leg 6 terminating in a surface 7, preferably contacting a side surface 15 of the frame 4 (see FIG. 5). As best seen in FIG. 1, the shell 3 is provided with a top edge 12 which may be slanted as shown. Frame 4 is a solid member provided with a template 2, a section preferably shaped as an inverted trapezoid integral with frame 4 and running the length thereof, raised above first and second coplanar surfaces 5 and 10, respectively. A exterior surface 22 is recessed from coplanar surface 5 thus forming a tiered surface upon frame 4 as seen in FIG. 5. The length of the frame 4 is defined by top and bottom edges 14 and 11, respectively, the former of which may also be slanted so as to be flush with edge 12 of shell 3 when the two units are engaged. The shell 3 and the frame 4 are combined by engaging groove 1 of shell 3 at a top edge 12 with the template 2 at bottom edge 11 and mating the two units such that top edges 12 and 14 are flush.

Figure 2:
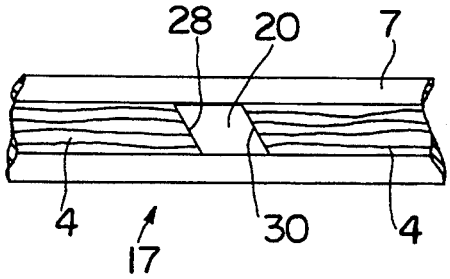
FIG. 2 is a bottom view of the shell and frame engaged demonstrating a gap in the frame material within the shell in accordance with the preferred embodiment of the present invention.

FIG. 2 illustrates the gap formed into the frame when the two units are engaged. Once the shell 3 and frame 4 are engaged, first surface 8 of shell 3 contacts first surface 5 of frame 4, and second surface 9 of shell 3 contacts second surface 10 of frame 4. A portion of surface 9 overhangs beyond a terminus of surface 10, as best seen in FIG. 5. Once the shell 3 and the frame 4 are engaged, the inner portion 9 and the outer portion 7 are the only surfaces of the shell 3 exposed when viewing the under side of a unit 17. Within the shell 3 exist frame members 4 which are coaxial but separated by a gap 20. Although the gap 20 can be rectangular, the gap 20 is preferably slanted to maximize the strength of the frame while still eliminating the problem of linear thermal expansion. When the unit 17 is exposed to differing temperatures, the frame members 4 expand thus causing the distance between faces 28 and 30 to fluctuate. In order to address the problem of linear thermal expansion, the faces 28 and 30 are sufficiently distanced to deal with the maximum temperatures at which the unit 17 would be exposed. If not for this distance and the existence of the gap 20, once the frame members 4 had expanded linearly and faces 28 and 30 made contact, then any further expansion would cause the unit 17 to bow.

Figure 3:
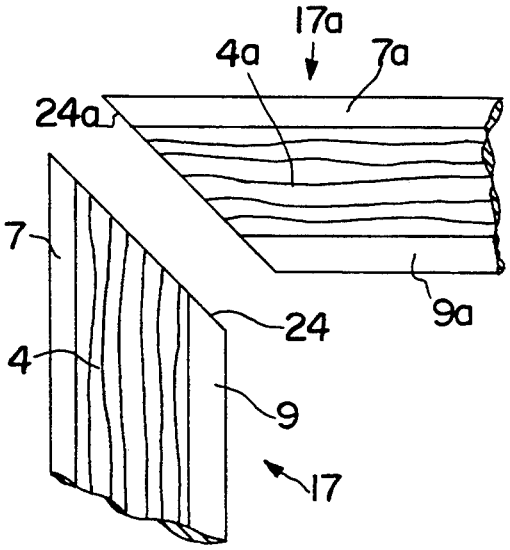
FIG. 3 is an exploded view of two corner members prior to engagement in a corner connection.
Figure 4:
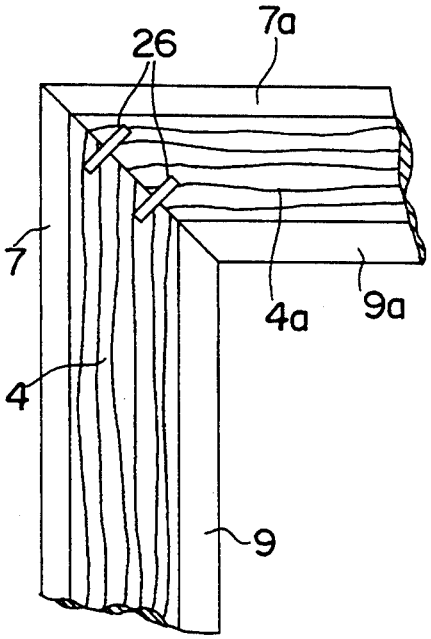
FIG. 4 is a plan view of the shell and frame engaged in a corner connection utilizing metal staples.

FIGS. 3 and 4 illustrate the corner connection formed between two corner units 17 and 17*a*. A corner unit is formed when the top edges 12 and 14 of the shell 3 and frame 4, respectively, are slanted at forty-five degree angles. Although forty-five degree angles are preferred, it is possible to form angular connections with other complementary arrangements. The shell 3 and frame 4 once engaged form a top surface 24. Units 17 and 17*a* are constructed with complementary surfaces 24 and 24*a* which can be laid flush together (as seen in FIG. 4). Once the surfaces 24 and 24*a* are in contact, any reasonable connecting means can be utilized. For instance, FIG. 4 shows the use of metal staples 26 to make such a connection. End portions of frames 4 and 4*a* and surfaces 7 and 7*a* and 9 and 9*a* are in contact once the units 17 and 17*a* are engaged.

FIG. 5 illustrates the preferred embodiment of the present invention wherein a slot 13 is formed into a terminal portion of one of the coplanar surfaces 8 of a frame 4. The slot 13 is formed between surfaces 5, 32, 22 and the interior portion of leg 6. Since surface 8 of shell 3 is not contacted along its entire width by surface 5, the frictional force required to slidably engage frame 4 and shell 3 is reduced. In addition, the slot 13 allows for lateral thermal expansion thus aiding in the prevention of system damage from bowing.

Many other variations of the above invention may be apparent to those skilled in the art upon reading the above description and examining the corresponding illustrations. Such variations are embodied in the spirit and scope of the invention as measured by the following claims.

That which is claimed:

1. A decorative molding comprising:

a frame, said frame including a raised template along an exterior surface of said frame;

a shell, said shell having an outer decorative surface and inner engaging surfaces, said inner engaging surfaces further defining a groove having dimensions complimentary to said raised template;

wherein said raised template and said groove slidably engage said frame with said shell and said frame being flush with said inner engaging surface of said shell except for in an area of a slot in said frame; and wherein a portion of said shell projects outwardly from one of said inner engaging surfaces to form a leg.

2. The decorative molding defined in claim 1 wherein said leg contacts a side surface of said frame upon engagement of said frame and said shell.

3. The decorative molding defined in claim 1 wherein said slot is formed into a terminal portion of said exterior surface.

4. The decorative molding defined in claim 1 wherein said template is an inverted trapezoid section integral with said frame.

5. The decorative molding defined in claim 1 wherein said frame is constructed of wood.

6. The decorative molding defined in claim 1 wherein said shell is constructed of plastic.

7. The decorative molding defined in claim 1 wherein said frame is interrupted in its length by a gap allowing said molding to compensate for differing rates of linear thermal expansion.

8. The decorative molding defined in claim 1 wherein top edges of said shell and said frame are slanted at an angle of forty-five degrees and combined to form a first unit.

9. The decorative molding defined in claim 8 wherein said first unit is placed in contact with a second unit constructed in accordance with said first unit allowing top surfaces of said units to be in contact and to lay flush together.

10. The decorative molding defined in claim 9 wherein said units are connected at said top surfaces by a connecting means.

11. The decorative molding defined in claim 10 wherein said connecting means is a metal staple.

12. A decorative molding comprising:

a frame including a raised template along an exterior surface of said frame and having a gap;

a shell having an outer decorative surface and inner engaging surfaces, said inner engaging surfaces further defining a groove having dimensions complimentary to said raised template;

wherein said raised template and said groove slidably engage said frame with said shell; and wherein said gap is provided at a slant to maintain the strength of the unit while eliminating the problem of linear thermal expansion.

* * * * *